US009186532B2

(12) United States Patent
von Blücher

(10) Patent No.: US 9,186,532 B2
(45) Date of Patent: Nov. 17, 2015

(54) EXTINGUISHING DEVICE, EXTINGUISHING SYSTEM, AND METHOD FOR LOCAL FIREFIGHTING

(75) Inventor: Hasso von Blücher, Erkrath (DE)

(73) Assignee: BLÜcher GMBH, Erkrath (DE)

( * ) Notice: Subject to any disclaimer, the term of this patent is extended or adjusted under 35 U.S.C. 154(b) by 1457 days.

(21) Appl. No.: 12/672,508

(22) PCT Filed: May 28, 2008

(86) PCT No.: PCT/EP2008/004240

§ 371 (c)(1),
(2), (4) Date: Jul. 11, 2011

(87) PCT Pub. No.: WO2009/018868

PCT Pub. Date: Feb. 12, 2009

(65) Prior Publication Data

US 2011/0259615 A1 Oct. 27, 2011

(30) Foreign Application Priority Data

Aug. 6, 2007 (DE) ..... 10 2007 036 902

(51) Int. Cl.
*A62C 2/00* (2006.01)
*A62C 35/02* (2006.01)
*A62C 99/00* (2010.01)

(52) U.S. Cl.
CPC ..... *A62C 35/02* (2013.01); *A62C 99/00* (2013.01)

(58) Field of Classification Search
CPC ..... A62C 3/00; A62C 3/0214; A62C 3/0292; A62C 37/38
USPC ..... 169/46, 47, 14, 16, 60; 239/406, 398, 239/303
See application file for complete search history.

(56) References Cited

U.S. PATENT DOCUMENTS

| | | | | |
|---|---|---|---|---|
| 4,531,588 | A * | 7/1985 | Brunsicke | 169/9 |
| 4,776,403 | A | 10/1988 | Lejosne | |
| 4,819,732 | A | 4/1989 | Laumeister | |
| 5,713,417 | A * | 2/1998 | Sundholm | 169/46 |
| 5,808,541 | A | 9/1998 | Golden | |
| 6,096,839 | A * | 8/2000 | Chinh et al. | 526/68 |
| 6,112,822 | A * | 9/2000 | Robin et al. | 169/46 |
| 6,390,203 | B1 * | 5/2002 | Borisov et al. | 169/62 |
| 6,637,518 | B1 * | 10/2003 | Hillier et al. | 169/46 |
| 7,032,681 | B1 * | 4/2006 | Sprakel | 169/58 |
| 7,670,513 | B2 * | 3/2010 | Erdner et al. | 252/610 |

FOREIGN PATENT DOCUMENTS

WO 2006085817 10/2006

* cited by examiner

*Primary Examiner* — Davis Hwu
(74) *Attorney, Agent, or Firm* — Edward E. Sowers; Brannon Sowers and Cracraft PC

(57) ABSTRACT

The invention relates to an extinguishing device designed for local firefighting in buildings on site at the source of a fire, said extinguishing device having a nozzle device having an extinguishing unit comprising a plurality of extinguishing nozzles designed for applying an extinguishing agent at the location of the source of the fire and for decentralized arrangement in the building, further comprising at least one extinguishing agent container connected to the extinguishing nozzles in a fluid-communicating fashion, at least one pressure-generating device for applying the extinguishing agent via the extinguishing nozzles, and at least one fire alarm sensor. According to the invention, the pressure-generating device is designed to generate an application pressure of at least 10 bar on the extinguishing agent.

3 Claims, 2 Drawing Sheets

EXTINGUISHING DEVICE, EXTINGUISHING SYSTEM, AND METHOD FOR LOCAL FIREFIGHTING

CROSS-REFERENCES TO RELATED APPLICATIONS

This application is a National Stage filing of International Application PCT/EP2008/004240, filed May 28, 2008, claiming priority to German Applications No. DE 10 2007 036 902.8 filed Aug. 6, 2007, entitled "Extinguishing Device, Extinguishing System, and Method for Local Firefighting." The subject application claims priority to PCT/EP2008/004240, and to German Applications No. DE 10 2007 036 902.8 and incorporates all by reference herein, in their entirety.

BACKGROUND OF THE INVENTION

The invention relates to an extinguishing device designed for local firefighting in buildings, at the location of the source of a fire, according to the precharacterizing clause of claim 1 and to a corresponding method according to the precharacterizing clause of claim 6. In addition, the present invention relates to an extinguishing system with a plurality of extinguishing devices of the aforementioned type according to claim 2.

Where buildings are fitted with extinguishing devices, they are, for example, sprinkler systems which are fitted in the building concerned or parts thereof, in particular on or in ceilings, and from the nozzles of which water is sprayed as an extinguishing agent in a case where the system is set off or there is a fire. Sprinkler systems are automatic fire extinguishing systems which are used for preventive fire protection in special buildings such as high-rise blocks, office buildings, department stores, industrial installations, conference centers and meeting places as well as underground garages. A number of water outlet nozzles, known as sprinkler heads, are provided on the ceiling of the room or in the upper region of the side walls and are connected to a network of water pipes. The water outlet nozzles are in turn sealed by glass ampoules, which are filled with a special dyed fluid. A sprinkler system is under a constant internal water pressure, which is monitored at the sprinkler control center. In the case of a fire, the special fluid in the glass ampoules heats up and expands, causing the ampoules to burst. As a result, the nozzles are opened and the extinguishing water is discharged from the network of sprinkler pipes. The resultant pressure drop is detected by a control device and leads to the opening of further valves and the starting of pumps. From this time, water is pumped into the sprinkler system at high pressure from tanks provided for the purpose or via a water connection dimensioned for the purpose. This water is discharged from all the open water nozzles and extinguishes or minimizes the fire.

One disadvantage of sprinkler systems is that they are often designed as systems that are interconnected over a large area, so that, in the case of just a small fire or in the case of a false alarm, considerable damage is caused by the sprayed extinguishing agent. Moreover, it is only with considerable effort that buildings can be retrofitted with the known, permanently installed sprinkler systems.

Also known from the prior art are extinguishing devices in which an extinguisher column is used for local firefighting in buildings, at the location of the source of a fire. Such room extinguisher columns comprise a transportable housing with extinguishing nozzles for discharging an extinguishing agent stored in the column that are arranged in a distributed fashion over the wall of said housing, a tank for receiving the extinguishing agent that is connected to the extinguishing nozzles, an energy supply module and a control module for activating an extinguishing function of the room extinguisher column that is connected to fire alarm sensors being arranged in the housing. The known room extinguisher columns may be set up in a decentralized arrangement in a building, it being possible for the room extinguisher columns to be operated fully autonomously with respect to the setting-off and extinguishing function. Thus, depending on the size of the room, a single room extinguisher column placed in the room concerned may be adequate. In the case of large rooms, it is also optionally possible for a number of room extinguisher columns to be set up. The known room extinguisher columns make it possible for a building to be retrofitted in a way that involves little effort in terms of structural measures and low costs, it then being possible for false alarms to affect only a single room extinguisher column, which results in less damage than in the case of the false alarm of a sprinkler system. The possibility of just extinguishing a fire locally in the surrounding region of the source of the fire allows damage attributable to the sprayed extinguishing agents to be limited, which is of advantage in particular in the case of comparatively small sources of fire occurring locally.

However, the known extinguisher columns only have comparatively low effectiveness in local firefighting. In particular, pockets of heat can only be extinguished inadequately with the known room extinguisher columns, which may result in the fire breaking out again after completion of the extinguishing operation.

BRIEF SUMMARY OF THE INVENTION

The invention is therefore based on the object of providing an extinguishing device, a method and an extinguishing system of the type respectively mentioned at the beginning which make effective firefighting possible in buildings, at the location of the source of a fire and in the direct vicinity of the source of the fire, it being intended in particular that pockets of heat are extinguished as completely as possible at the location of the source of the fire.

To achieve the aforementioned object, in the case of an extinguishing device which has an extinguishing unit having a nozzle device with a plurality of extinguishing nozzles designed for discharging extinguishing agent, preferably liquid extinguishing agent, just at the location of the source of a fire and for decentralized arrangement in the building, has at least one extinguishing agent container connected to the extinguishing nozzles in a fluid-communicating fashion, has at least one pressure-generating device for discharging the extinguishing agent via the extinguishing nozzles and has at least one fire alarm sensor, it is provided that the pressure-generating device is designed for generating a discharge pressure of the extinguishing agent of at least 10 bar, preferably up to 1500 bar, in particular between 20 and 200 bar.

DETAILED DESCRIPTION OF THE INVENTION

Figure 1:
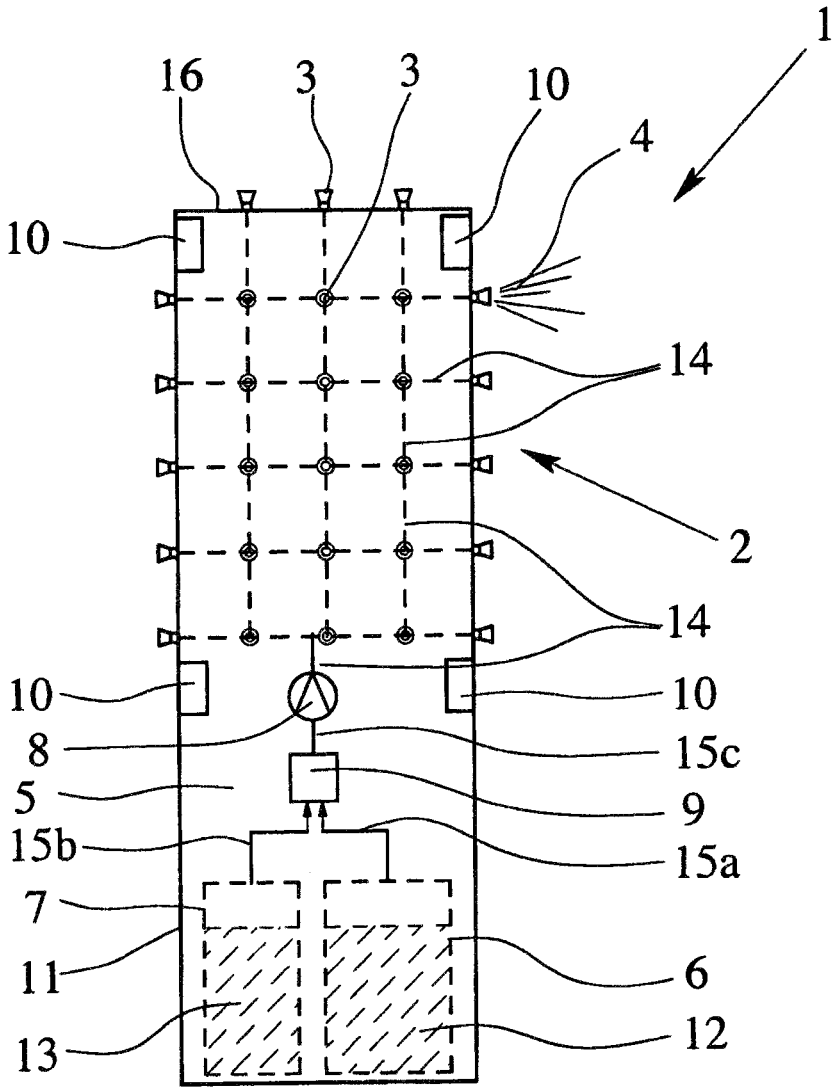
FIG. 1 provides a schematic cross-sectional view of an extinguishing device according to the invention designed for local firefighting in buildings, at the location of the source of a fire.

According to the invention, the extinguishing agent is discharged from the extinguishing nozzles at high pressure, which requires a corresponding design of the pressure-generating device. The pressure-generating device may have for this purpose at least one (high-pressure) pump. In connection with the invention, it has been possible to find that the discharge of the extinguishing agent at high pressure results in a fire being put out more quickly and completely, it being possible in particular for pockets of heat or fire to be extinguished quickly and completely. Moreover, the amount of extinguishing agent required to put out the source of a fire can be reduced significantly by the high-pressure discharge of the extinguishing agent, which reduces the occurrence of damage caused by the discharged extinguishing agent.

It may preferably be provided that extinguishing agent is discharged or sprayed as a spray mist. It goes without saying that in this case the nozzle device must be correspondingly designed and the pressure level of the extinguishing agent must be correspondingly high, in order to discharge the extinguishing agent at high pressure in a finely distributed form in the manner of a mist.

The apex angle of the spray cone produced by an extinguishing nozzle may be less than 15°, preferably less than 10°. The smaller the apex angle of the spray cone produced, the more the spray cone approximates to a jet, which ensures a correspondingly greater range of the extinguishing agent discharged via the extinguishing nozzles.

The extinguishing unit may preferably be formed as an extinguisher column, the term "column" not being confined to a three-dimensional formation with a circular cross section. Rather, three-dimensional formations which have a polygonal cross section are also conceivable. Two-dimensional formations, such as panel-like extinguishing units, are also covered by the invention. If the extinguishing units are designed in the manner of columns, they may extend in the longitudinal direction from a floor of the building up to a room height of at least 1.5 m, preferably at least 2.5 m. The extinguisher columns may additionally be used for decorative purposes or for advertising purposes, although it must be ensured that unhindered discharge of the extinguishing agent via the extinguishing nozzles is ensured at all times.

If the extinguishing unit is intended for setting up on a floor of the building and has an elongate housing, the nozzles may be arranged such that they are distributed over the wall of the housing, preferably evenly distributed. It has been found in connection with the invention that a particularly good fire extinguishing effect is obtained from an extinguishing unit set up on the floor of a building if the nozzles are arranged in the longitudinal direction of the wall of the housing at a distance of at least 1.0 to 3.5 m above the floor, in which case, preferably, the nozzles should be provided at least in the upper third of the wall of the housing. To increase the range of discharge of the extinguishing agent still further, at least one nozzle or, preferably, a plurality of nozzles may be provided on an upper end face of the wall of the housing.

In the simplest case, water is used as the extinguishing agent. The extinguishing agent may, however, also have at least one hydrophilic, intumescent component, in which case, preferably, the intumescent component is dispersible in water, and in which case, more preferably, the component is a superabsorbent polymer. Hydrophilic intumescent materials that can be used as extinguishing agents are known, for example, from DE 35 15 865 A1 and DE 38 14 751 A1, each of the applicant. For example, intumescent polymers based on polyacrylate or polymethacrylate and/or based on modifications may be used.

For example, a concentrate with the trade name Firesorb®, from the Degussa company, is known from the prior art. Firesorb® is a liquid polymer preparation which can absorb many times its own weight in water. As it does so, there forms a heat-shielding gel, which sticks even to ceilings and vertical walls. On account of its high viscosity, the Firesorb® gel flows only slowly away from the material on fire, and therefore has a longer extinguishing effect. The protective film absorbs the heat of combustion at the surface, while underneath there is the air-excluding function. Water mixed with Firesorb® acts like a liquid extinguishing blanket, choking the fire by excluding air and providing a cooling effect. Firesorb® is a concentrate of superabsorbent polymer particles slightly pre-swollen with water. By incorporation in a special biodegradable oil, the polymers are prevented from further water absorption. In this form, the additive can be transported and handled very well. As soon as the pre-swollen polymers are added in apportioned amounts to larger amounts of water, the water binding speeds up considerably. This effect can be further intensified by stirring or pumping. According to the example last described, it may be provided in the case of the invention that the extinguishing agent is obtainable from a mixture of extinguishing water with a concentrate of the type described above as an extinguishing water additive.

If the extinguishing agent is obtainable by mixing extinguishing water with an extinguishing water additive, two extinguishing agent containers may be provided, a first extinguishing agent container being provided for receiving extinguishing water and a second extinguishing agent container being provided for receiving the extinguishing water additive. If the mixing is to be carried out before discharge from the extinguishing nozzles, a mixing device is required to mix the extinguishing water and the extinguishing water additive to form the usable extinguishing agent. In this case, the extinguishing water and the extinguishing water additive may be fed to the nozzle device separately from one another and only mixed directly before discharge. If it is provided that the extinguishing water and the extinguishing water additive should be mixed before discharge, it goes without saying that the extinguishing nozzles are designed correspondingly, preferably for extremely fine atomization of the mixture of extinguishing water and extinguishing water additive that is passed through. In this connection, it also goes without saying that, after the mixing of the extinguishing water and the extinguishing water additive, further swelling of an intumescent component contained in the extinguishing water additive may occur, allowance for which must be correspondingly made in the design of the nozzle device.

To ensure dependable discharge of the extinguishing agent, it may also be provided that the extinguishing water and the extinguishing water additive are discharge separately from one another. Therefore, in fact two different extinguishing agents, namely extinguishing water and extinguishing water additive, are discharged. In this case, it may be envisaged to discharge the extinguishing water in the form of a mist with very small liquid droplets and to discharge the extinguishing water additive with larger liquid droplets. This then has the result that, in the vicinity of the source of a fire, the extinguishing water evaporates largely completely, thereby absorbing heat, while the extinguishing water additive comes to lie on the source of the fire as a liquid extinguishing blanket.

The discharge rate of the extinguishing agent may be between 100 and 5000 l/h, preferably between 500 and 2500 l/h. In this connection, the first extinguishing agent container for the extinguishing water may have a filling volume of between 10 and 1000 l, preferably between 100 and 750 l, in which case, preferably, the second extinguishing agent container for the extinguishing water additive may contain a smaller volume. It goes without saying that in principle two extinguishing agent containers may also be designed to be of the same size. If the extinguishing water and the extinguishing water agent are discharged separately from one another, the discharge rate for the extinguishing water and the extinguishing water additive may be respectively between 100 and 5000 l/h, preferably between 500 and 2500 l/h.

To extinguish the source of a fire as completely as possible, it is generally required to discharge the extinguishing agent over a total time period of 1 to 10 minutes, preferably 2 to 5 minutes. To reduce the amount of extinguishing agent discharged altogether in an extinguishing operation, it may be envisaged to discharge the extinguishing agent in a number of cycles, it being possible for the overall time period of the extinguishing agent discharge to comprise a plurality of cycles and each cycle preferably having a time period of less than 1 minute.

To make autonomous operation of the extinguishing device possible, the pressure-generating device, in particular a pump, and an electric motor as the drive for the pump, may be arranged within the extinguishing unit. The arrangement of the pressure-generating device within the extinguishing unit allows the extinguishing device to be designed in a transportable fashion. If the location where the extinguishing device is set up or the corresponding building allows, according to one exemplary embodiment of the invention it may also be provided that the extinguishing agent container or containers is/are connectable to an external pressure supply.

In the case of a preferred embodiment, it is provided that the extinguishing agent container is arranged within the extinguishing unit, in which case, preferably, the extinguishing agent container may be formed by a wall of the housing of the extinguishing unit. This makes it possible to supply the extinguishing device with extinguishing agent independently of a stationary extinguishing agent line provided in the building, which however is also possible in principle. The extinguishing agent container may be connectable to an external extinguishing agent supply via an additional connection provided on the housing, which makes it possible to make a greater amount of extinguishing agent available in the case of a fire.

If it is intended to obtain the extinguishing agent by mixing extinguishing water with an extinguishing water additive, the mixing device required for this purpose may likewise be arranged within the extinguishing unit. If autonomous operation of the extinguishing device is intended, an energy supply device is required for the operation of the pressure-generating device and must likewise be arranged in the extinguishing unit. The energy supply device has, for example, a rechargeable battery as an energy store. It goes without saying that the extinguishing device according to the invention may also be connectable to an external energy supply, it generally being possible for such a connection of the extinguishing device to the power supply provided in the building to be realized in an easy and flexible fashion.

In the case of a preferred embodiment of the invention, the extinguishing unit is arranged at a fixed location in the building. In this connection, means for fastening or setting up the extinguishing agent on a wall or on a floor of the building may be provided. In principle, however, it is also possible for the extinguishing unit to be designed in a transportable fashion, in which case means for suspending or clamping it to existing holding fixtures on ceilings or walls or else to rollers, wheels or the like that allow the extinguishing unit to be moved along may be provided.

To activate an extinguishing function of the extinguishing device, a control device connected to the fire alarm sensor may be provided. The operation of the extinguishing device is controlled by means of the control device, the extinguishing function concerning the discharge of extinguishing agent in the case of a fire. Here, too, the control device is preferably arranged within the extinguishing unit, the invention also allowing if need be, in the case of an extinguishing system with a plurality of extinguishing devices, the control of the extinguishing devices to be interlinked, it being possible for the extinguishing devices to be controlled by means of a central control system. In the case of a plurality of extinguishing devices, each extinguishing device may be operable in the extinguishing function independently of further extinguishing devices. It is consequently possible to activate, or use for extinguishing the source of a fire, only those extinguishing devices that are arranged directly adjacent the source of the fire. Directly adjacent means, for example, within an area around the source of the fire with a radius of 5 to 15 m. As a result, damage in the building caused by the discharged extinguishing agent in the case of a false alarm or in the case of locally occurring fires can be locationally limited.

To restrict the use of space in the building by the extinguishing devices as little as possible, adjacent extinguishing devices in the case of an extinguishing system may be spaced apart by less than 3 m, preferably less than 5 m. However, the spacing between the extinguishing devices should only be chosen to be of such a size that an adequate extinguishing effect in the case of a fire is still ensured in the region between two adjacent extinguishing devices.

A plurality of adjacent extinguishing devices in an extinguishing system may also be operable simultaneously, the activation of the extinguishing function of a first extinguishing device, arranged in the vicinity of the source of a fire, only leading automatically to the activation of the extinguishing functions of those further extinguishing devices of the extinguishing system that are arranged directly adjacent the first extinguishing device. On the other hand, the extinguishing devices that are not arranged directly adjacent the first extinguishing device are not activated or not switched into an extinguishing function. This presupposes an interlinkage of the control of the extinguishing devices, for example all the extinguishing devices in an area around the source of a fire of about 5 to 15 m being automatically activated as soon as the extinguishing device located closest to the source of the fire has been activated.

A common control device for all the extinguishing devices in an extinguishing system makes it possible to control or activate the extinguishing devices from a central location in the building, such as a control console or the like, in order to make targeted firefighting possible.

The invention additionally relates to an extinguishing device and a method for local firefighting outside buildings, at the location of the source of a fire.

When firefighting on open terrain, for example fighting forest fires, not only firefighting planes and complete sets of firefighting vehicles are used but often also smaller mobile extinguishing units, in particular when fighting pockets of heat or fire. These mobile extinguishing units comprise a storage tank, which can be carried on the back, and a spray device for spraying extinguishing water stored in the storage tank onto pockets of fire or heat. However, this is only effective to a minor extent, since on the one hand the amount of extinguishing water is limited and on the other hand only small areas can be wetted with the extinguishing water in this way.

It is an object of the present invention to provide an extinguishing device and an extinguishing method respectively of the aforementioned type which make local firefighting outside buildings possible, at the location of the source of a fire, with high efficiency and which can be handled easily.

To achieve the aforementioned object, the extinguishing device according to the invention has at least one mobile extinguishing unit, having a mobile extinguishing agent container, at least one manually actuable high-pressure spray device with at least one extinguishing nozzle, connected to the extinguishing agent container in a fluid-communicating fashion, and at least one pressure-generating device for discharging extinguishing agent via the high-pressure spray device onto the source of a fire, the pressure-generating device being designed for generating a discharge pressure of the extinguishing agent of at least 10 bar, preferably up to 1500 bar, in particular between 20 and 200 bar. Accordingly, in the case of the method according to the invention, it is provided that the extinguishing agent is discharged at high pressure.

At this point, the invention is based firstly on the basic idea of designing the extinguishing unit with the extinguishing agent container in a mobile fashion, so that it can be moved into the direct vicinity of the source of a fire. This makes a greater fluid reservoir for extinguishing agent available at the location of the source of the fire in comparison with the previously known portable extinguishing units. In the simplest case, the extinguishing unit may be moved along by muscle power. However, it is also possible in principle to provide a motor drive for moving it along on open terrain. Removal of the extinguishing agent from the extinguishing agent container takes place via the high-pressure spray device, which is preferably carried and operated by a firefighter. The high-pressure spray device is connected to the extinguishing agent container in a fluid-communicating fashion, the desired high pressure being generated by means of the pressure-generating device. For this purpose, the pressure-generating device may have at least one (high-pressure) pump. In principle, a number of high-pressure spray devices may also be connected to one extinguishing unit. It is similarly possible for the pressure-generating device to be integrated in the high-pressure spray device, so that the extinguishing unit is merely provided as an extinguishing agent store.

It has surprisingly been found in connection with the invention that it makes it possible for the extinguishing agent to be discharged at high pressure to extinguish pockets of heat or fire with high efficiency. Preferably, the extinguishing agent is discharged in the form of a finely distributed mist or spray mist, which likewise contributes to an improved extinguishing effect. The combination of the high-pressure technique and the high-pressure nozzle makes particularly fine atomization of the extinguishing agent possible. The small droplets evaporate completely, and thereby extract maximum energy from the fire. In practice, this produces an optimum extinguishing effect of the water used. By exchanging the extinguishing nozzles or by simple turning, an adjustment of the spray jet can be achieved right up to a solid jet. Preferably, the apex angle of the spray cone produced by an extinguishing nozzle should be less than 15°, preferably less than 10°. With a still smaller apex angle, it is also possible in principle to discharge the extinguishing agent as a solid jet.

In the simplest case, the extinguishing agent is water. The extinguishing agent may, however, also have at least one hydrophilic, intumescent component, in which case, preferably, the intumescent component should be dispersible in water. In particular, intumescent polymers, for example based on polyacrylate or polymethacrylate and/or based on modifications, may be added to the extinguishing water as extinguishing water additives. In this connection, at least two extinguishing agent containers may be provided, in which case a first extinguishing agent container may be provided for receiving extinguishing water and a second extinguishing agent container may be provided for receiving the extinguishing water additive. A concentrate of superabsorbent polymer particles may be contained in the second extinguishing agent container as an extinguishing additive, the polymer particles being slightly pre-swollen with water and prevented from further water absorption by bringing them into an organic phase.

To mix the extinguishing water and the extinguishing water additive, a mixing device is provided, the extinguishing water and the extinguishing water additive preferably being fed to the extinguishing nozzle separately from one another and only mixed with one another directly before the discharge of the extinguishing agent. The water binding of superabsorbent polymer particles speeds up considerably during the mixing. Here it must be ensured that the discharge is not hindered by the swelling. This presupposes a corresponding design of the extinguishing nozzle. In principle, however, it may also be envisaged to discharge the extinguishing water and the extinguishing water additive simultaneously via separate extinguishing nozzles or one after the other via the same extinguishing nozzles. Here it may further be envisaged to discharge the extinguishing water in a finely distributed fashion in the form of a mist, while the extinguishing water additive is discharged in a less finely distributed fashion with larger liquid drops. If the extinguishing water additive is superabsorbent polymer particles in the state of a gel, they come to lie like a carpet over the source of the fire, so that the latter is choked. On the other hand, the finely distributed extinguishing water evaporates completely, and consequently extracts a great amount of heat from the fire. In principle, it is also possible to discharge the extinguishing water additive by high-pressure discharge in the form of a finely distributed mist over a large area, which covers a greater surface area.

The discharge rate of the extinguishing agent should be between 100 and 2500 l/h, preferably between 500 and 1600 l/h. In this connection, the first extinguishing agent container for the extinguishing water may have a filling volume of at least 50 l, in particular between 100 and 500 l. The second extinguishing agent container for the extinguishing water additive preferably has a smaller volume. Depending on the type of drive of the extinguishing unit, the filling volume of the first and/or second extinguishing agent container may also be correspondingly greater. Here it is a matter of the filling volume of the extinguishing agent container or containers allowing the extinguishing unit to be moved along on open terrain.

To supply power independently of a set of firefighting vehicles or a stationary energy supply line, an energy supply device may be provided in the extinguishing unit, it being possible for the energy supply device to have at least one rechargeable battery as an energy store. Instead of a rechargeable battery, a generator, preferably a gasoline-operated generator, may also be used.

To ensure that pockets of heat or fire are extinguished completely, the extinguishing agent should be discharged over a time period of 1 to 10 minutes, preferably 2 to 5 minutes. To ensure an extinguishing effect of the available amount of extinguishing agent that is as optimum as possible, it may be envisaged to discharge the extinguishing agent in cycles, a prescribed amount of the extinguishing agent being respectively discharged in short bursts of spray. A corresponding control device may be provided for this purpose. Alternatively, the discharge of the extinguishing agent may also be manually controlled.

Moreover, if need be, the invention allows the features mentioned in the claims and/or the features described on the basis of the drawing to be combined with one another, even if this has not specifically been described. A combination of previously described features of the extinguishing devices that are designed for local firefighting in buildings with features of such extinguishing devices that are designed for local firefighting outside buildings is also possible. The figures given above and the specified intervals in each case cover all values, that is to say not only the lower limits, or in the case of intervals the interval limits, without this having to be mentioned expressly.

Figure 2:
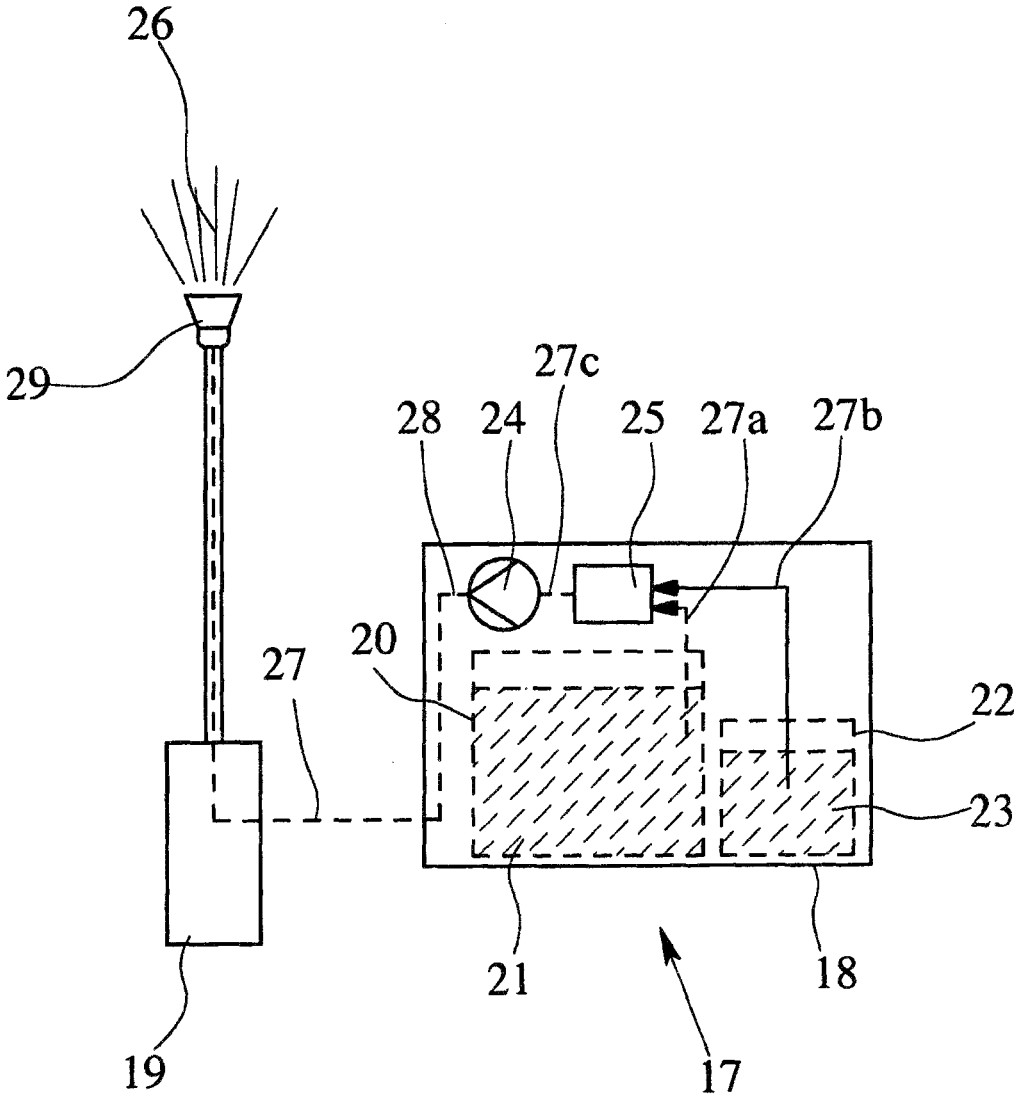
FIG. 2 provides a schematic cross-sectional view of an extinguishing device according to the invention designed for local firefighting outside buildings, at the location of the source of a fire.

To be specific, there are many possible ways of refining and developing the extinguishing devices according to the invention and the methods according to the invention, reference being made on the one hand to the dependent patent claims and on the other hand to the following detailed description of preferred exemplary embodiments of the invention with reference to the drawing, in which:

FIG. 1 shows a schematic cross-sectional view of an extinguishing device according to the invention designed for local firefighting in buildings, at the location of the source of a fire, and FIG. 2 shows a schematic cross-sectional view of an extinguishing device according to the invention designed for local firefighting outside buildings, at the location of the source of a fire.

In FIG. 1, an extinguishing device 1 designed for local firefighting in buildings, at the location or in the direct vicinity of the source of a fire, is schematically represented. The extinguishing device 1 has a nozzle device 2 with a plurality of extinguishing nozzles 3, designed for discharging extinguishing agent 4 just at the location or in the direct vicinity of the source of the fire and for decentralized arrangement in a building (not represented). The discharge of the extinguishing agent 4 is schematically represented in FIG. 1 just for a single extinguishing nozzle 3. It goes without saying that, in the case of a fire, the extinguishing agent 4 is discharged from a plurality of extinguishing nozzles 3, preferably from all the extinguishing nozzles 3.

The nozzle device 2 is an integral component part of an extinguishing unit 5, which is designed as an extinguisher column and in the embodiment represented has two extinguishing agent containers 6, 7 as well as a pressure-generating device 8 and a mixing device 9. Also provided are a plurality of fire sensors 10 for detecting a fire, which are set in particular to provide a combined optical, smoke, CO and temperature indication. The data recorded by the fire alarm sensors 10 are transmitted to a control device (not specifically represented), the control device bringing about the activation of an extinguishing function in dependence on the signals received. After activation of the extinguishing function, extinguishing agent 4 is issued via the extinguishing nozzles 3. A remote indicating function for the transmission of a message to a prescribed receiver may additionally be integrated in the control device. In the same way as the extinguishing nozzles 3, the fire alarm sensors 10 are arranged such that they are distributed over a wall of the housing 11 of the extinguishing unit 5.

The extinguishing agent 4 is obtainable from a mixture of extinguishing water 12 and at least one extinguishing water additive 13, a concentrate in the form of a gel comprising at least one polymer pre-swollen in water in an organic phase being used as the extinguishing water additive 13. The extinguishing water 12 is stored in the first extinguishing agent container 6 and the extinguishing water additive 13 is stored in the second extinguishing agent container 7. In the case of a fire, after activation of the extinguishing function, extinguishing water 12 and extinguishing water additive 13 are sucked out by the pressure-generating device 8 in a prescribed mixing ratio and passed to the mixing device 9. It is preferably provided that an apportioned amount of 1 to 10%, in particular of 2 to 3%, of the extinguishing water additive 13 is added to the extinguishing water 12. The pressure-generating device 8 thereby generates the discharge pressure of the extinguishing agent 4 required for discharging the extinguishing agent 4 via the extinguishing nozzles 3 of at least 10 bar, preferably up to 1500 bar, in particular between 20 and 200 bar. In the case of a further preferred embodiment, a discharge pressure of about 40 bar is generated. The pressure-generating device 8, which in the simplest case may be a pump, is connected via pressure lines 14 to the extinguishing nozzles 3 on the one hand and via suction lines 15*a-c* to the mixing device 9 and the two extinguishing agent containers 6, 7.

In the case of a fire, the extinguishing agent 4 is discharged under positive pressure, the extinguishing agent 4 being discharged as a spray mist. The high-pressure discharge of the extinguishing agent 4 makes particularly fine atomization of the extinguishing agent possible. In practice, this produces an optimum extinguishing effect of the extinguishing agent 4 used. Moreover, the temperature level of the area in the vicinity of the source of the fire is lowered very quickly and suspended particles are washed out of the ambient air. Consequently, the visibility range in the area affected by fire is also positively influenced. The low consumption of extinguishing agent with extremely high efficiency provides low-cost protection for the contents of a building, with a very short time period within which the source of the fire can be extinguished completely. Moreover, it is ensured by the high-pressure discharge of the extinguishing agent 4 that pockets of heat or fire can be extinguished completely, so that there is no need to fear that the fire may break out again.

The extinguishing water additive 13 contains superabsorbent polymer particles which are slightly pre-swollen with water. By incorporation in a special biodegradable oil, the polymers are prevented from further water absorption. In this form, the extinguishing water additive 13 can be transported and handled well. As soon as the extinguishing water additive 13 is mixed with the extinguishing water 12 in the mixing device 9, there is renewed water binding, it being possible for this effect is to be intensified by stirring or pumping. In the case of the extinguishing device 1 represented in FIG. 1, it is therefore required that, after the mixing of extinguishing water 12 and extinguishing water additive 13, the extinguishing water mixture obtained is discharged via the extinguishing nozzles 3 as quickly as possible, before the degree of swelling of the polymer particles has increased to such an extent that spraying of the extinguishing agent 4 is no longer possible or is hindered. After spraying, the polymer particles contained in the extinguishing water additive 13 come to lie like an extinguishing carpet over the source of the fire and choke it.

It is not shown that it may also be envisaged to mix the extinguishing water 12 and the extinguishing water additive 13 only directly before discharge from the extinguishing nozzles 3, or else to spray them via the extinguishing nozzles 3 separately from one another. If the extinguishing water 12 and the extinguishing water additive 13 are sprayed separately from one another, two pressure-generating devices 8 may be provided to build up the necessary discharge pressure of the extinguishing water 12 on the one hand and of the extinguishing water additive 13 on the other hand. Here, extinguishing nozzles 3 for the extinguishing water 12 on the one hand and further extinguishing nozzles 3 for the extinguishing water additive 13 on the other hand may be provided and correspondingly designed. If the extinguishing water 12 and the extinguishing water additive 13 are sprayed separately from one another, it may happen when there is an adequate amount of extinguishing water 12 that the pre-swollen polymer particles contained in the extinguishing water additive 13 swell still further after spraying, thereby absorbing extinguishing water 12, which has a favorable influence on the extinguishing effect.

In addition, it is pointed out that, in the case of a fire, discharge of the extinguishing agent 4 is preferably provided via the extinguishing nozzles 3 facing the source of a fire. Here, the fire alarm sensors 10 may be designed in such a way that not only the occurrence of the source of a fire but also the alignment thereof in relation to the extinguishing unit 5 is passed on as control information to the control device. Dependent on the side on which the source of the fire is localized, the discharge of the extinguishing agent 4 then takes place just on one side or the other, or on the outer side of the extinguishing unit 5 that is facing the source of the fire. To ensure a great extinguishing effect, the extinguishing nozzles 3 are preferably arranged in an evenly distributed fashion over the wall of the housing 11 of the extinguishing unit 5, the extinguishing nozzles 3 in the case of the embodiment represented extending over the entire upper half of the wall of the housing 11. Moreover, a plurality of extinguishing nozzles 3 are provided on an upper end face 16 of the wall of the housing 11. As a result, the extinguishing agent discharge can take place over the entire outer surface, including the upper end face 16, of the extinguishing unit 5, is also being possible in principle for extinguishing nozzles 3 also to be provided in the region of the lower half of the wall of the housing 11.

Also not shown is that an energy supply device is provided in the extinguishing unit 5, the energy supply device having at least one rechargeable battery as an energy store for operating the pressure-generating device 8. Moreover, the extinguishing unit 5 designed as an extinguisher column can, if need be, be arranged such that it is transportable or else at a fixed location in the building.

In FIG. 2, an extinguishing device 17 which is designed for local firefighting outside buildings, at the location or in the direct vicinity of the source of a fire, is represented. The extinguishing device 17 has a schematically represented mobile extinguishing unit 18 and at least one schematically represented high-pressure spray device 19. Also arranged within the extinguishing unit 18 are a first extinguishing agent container 20 for extinguishing water 21 and a second extinguishing agent container 22 for an extinguishing water additive 23. The extinguishing water additive 23 corresponds to the extinguishing water additive 13 that is used in the case of the extinguishing device 1 represented in FIG. 1.

Moreover, the extinguishing unit 18 has a pressure-generating device 24 and a mixing device 25. By means of the pressure-generating device 24, which is a high-pressure pump, the necessary discharge pressure for an extinguishing agent 26 is built up, the extinguishing agent 26 being obtainable by mixing extinguishing water 21 with the extinguishing water additive 23 in a prescribed mixing ratio in the mixing device 25. It is preferably provided that an apportioned amount of 1 to 10%, in particular of 2 to 3%, is added to the extinguishing water 21. The extinguishing water 21 and the extinguishing water additive 23 are thereby sucked to the mixing device 25 by the pressure-generating device 24 via suction lines 27*a* and 27*b*. The extinguishing agent 26 is then fed via the further suction line 27*c* and a pressure line 28 to an extinguishing nozzle 29 of the high-pressure spray device 19. The discharge of the extinguishing agent 26 takes place in the form of a spray mist at high pressure, which leads to the advantages in the extinguishing operation that were described in connection with the extinguishing device 1 represented in FIG. 1.

The high-pressure spray device 19 can be manually carried and actuated by a firefighter, so that the spray mist of the extinguishing agent 26 can be directed in a targeted fashion onto the location of the source of a fire. It is also not shown that the extinguishing unit 18 has an energy supply device with at least one rechargeable battery as an energy store for the pressure-generating device 24. Consequently, autonomous operation of the extinguishing device 17 is possible independently of a stationary power supply. Instead of a rechargeable battery, the energy supply device may also have a generator.

The extinguishing device 17 represented in FIG. 2 makes it possible to transport a relatively large amount of extinguishing water to the location of the source of a fire and to discharge the extinguishing water 21 together with the extinguishing water additive 23 by means of the high-pressure spray device 19, so that in particular pockets of heat and fire can be effectively fought.

The invention claimed is:

1. Extinguishing system comprising a plurality of extinguishing devices and extinguishing functions designed for local firefighting in buildings, at the location of the source of a fire, the extinguishing device comprising:

an extinguishing unit having a nozzle device with a plurality of extinguishing nozzles designed for discharging an extinguishing agent at the location of the source of a fire and for decentralized arrangement in the building, a first extinguishing agent container for receiving extinguishing water, a second extinguishing agent container for receiving an extinguishing water additive, the first and second extinguishing agent containers connected to the extinguishing nozzles in a fluid-communicating fashion, at least one pressure-generating device for discharging the extinguishing agent via the extinguishing nozzles, and at least one fire alarm sensor, the pressure-generating device being designed for generating a discharge pressure of the extinguishing agent of at least 10 bar and the extinguishing agent being dischargable as a spray mist, wherein the extinguishing agent is obtainable from a mixture of extinguishing water with at least one extinguishing water additive, wherein a concentrate comprising at least one pre-swollen superabsorbent polymer in an organic phase is provided as the extinguishing water additive, wherein the organic phase is a biodegradable oil preventing the polymer from further water absorption before mixing with the extinguishing water, wherein the extinguishing water and the extinguishing water additive are fed separately from one another and only mixed with one another directly before the discharge of the extinguishing agent through the extinguishing nozzles, wherein at least one extinguishing device is operable in the extinguishing function independently of other, further extinguishing devices, wherein a common control device is provided for the plurality of extinguishing devices, wherein a plurality of adjacent extinguishing devices are operable simultaneously, and wherein the activation of the extinguishing function of a first extinguishing device only leads to the automatic activation of the extinguishing functions of those further extinguishing devices that are arranged directly adjacent to the first extinguishing device, and wherein those further extinguishing devices that are not arranged directly adjacent to the first extinguishing device are not automatically activated by activation of the extinguishing function of the first extinguishing device.

2. The extinguishing system as claimed in claim 1, wherein each extinguishing device is operable in the extinguishing function independently of other, further extinguishing devices.

3. A method for local firefighting in buildings by means of an extinguishing system having a plurality of extinguishing devices and extinguishing functions as claimed in claim 1, the extinguishing device comprising:

an extinguishing unit with a nozzle device having a plurality of extinguishing nozzles, the extinguishing unit being designed for discharging extinguishing agent at the location of the source of a fire and for decentralized arrangement in the building, a first extinguishing agent container for receiving extinguishing water, a second extinguishing agent container for receiving an extinguishing water additive, the first and second extinguishing agent containers connected to the extinguishing nozzles in a fluid-communicating fashion, at least one pressure-generating device for discharging the extinguishing agent via the extinguishing nozzles and at least one fire alarm sensor;

wherein the extinguishing agent is discharged at a positive pressure of at least 10 bar as a spray mist, and wherein the extinguishing agent is obtained from a mixture of extinguishing water with at least one extinguishing water additive, wherein a concentrate comprising at least one pre-swollen superabsorbent polymer in an organic phase is used as the extinguishing water additive, wherein the organic phase is a biodegradable oil preventing the polymer from further water absorption before mixing with the extinguishing water, wherein the extinguishing water and the extinguishing water additive are fed separately from one another and only mixed with one another directly before the discharge of the extinguishing agent through the extinguishing nozzles, wherein at least one extinguishing device is operated in the extinguishing function independently of other further extinguishing devices, wherein a common control device is provided for the plurality of extinguishing devices, wherein a plurality of adjacent extinguishing devices are operated simultaneously, and wherein the activation of the extinguishing function of a first extinguishing device only leads to the automatic activation of the extinguishing functions of those further extinguishing devices that are arranged directly adjacent the first extinguishing device and wherein those further extinguishing devices that are not arranged directly adjacent to the first extinguishing device are not automatically activated by activation of the extinguishing function of the first extinguishing device.

* * * * *